US012467211B2

(12) United States Patent
Oldewurtel et al.

(10) Patent No.: US 12,467,211 B2
(45) Date of Patent: Nov. 11, 2025

(54) DEVICE FOR FIXING AND POSITIONING A RAIL MONITORING ELEMENT AND USE OF SAID DEVICE

(71) Applicant: Thales Management & Services Deutschland GmbH, Ditzingen (DE)

(72) Inventors: Kassen Oldewurtel, Markgroeningen (DE); Kai Schicker, Mehltheuer (DE)

(73) Assignee: Thales Management & Services Deutschland GmbH, Ditzingen (DE)

( * ) Notice: Subject to any disclaimer, the term of this patent is extended or adjusted under 35 U.S.C. 154(b) by 874 days.

(21) Appl. No.: 17/651,411

(22) Filed: Feb. 16, 2022

(65) Prior Publication Data

US 2022/0170215 A1 Jun. 2, 2022

Related U.S. Application Data

(63) Continuation of application No. PCT/EP2020/072881, filed on Aug. 14, 2020.

(30) Foreign Application Priority Data

Aug. 20, 2019 (EP) ..... 19192517

(51) Int. Cl.
*E01B 29/32* (2006.01)
*E01B 26/00* (2006.01)

(52) U.S. Cl.
CPC ..... *E01B 29/32* (2013.01); *E01B 26/00* (2013.01)

(58) Field of Classification Search
CPC ..... E01B 26/00; E01B 26/005; E01B 29/32; E01B 35/00
See application file for complete search history.

(56) References Cited

U.S. PATENT DOCUMENTS 11,524,711 B2 12/2022 Schicker et al.

FOREIGN PATENT DOCUMENTS

| | | | | |
|---|---|---|---|---|
| CN | 207027286 U | 2/2018 | | |
| CN | 208188051 U | 12/2018 | | |
| CN | 109263683 A | 1/2019 | | |
| DE | 27 12 365 A1 | 9/1978 | | |
| DE | 10 2015 209 721 B3 | 10/2016 | | |
| DE | 20 2017 104882 U1 | 11/2018 | | |
| DE | 10 2017 216 811 A1 | 3/2019 | | |
| EP | 863256 A2 * | 9/1998 | ..... | E01B 19/003 |
| EP | 3 169 138 A1 | 5/2017 | | |
| JP | H11-271153 A | 10/1999 | | |
| JP | 2002-294604 A | 10/2002 | | |
| JP | 2003-062691 A | 3/2003 | | |
| JP | 2010-007452 A | 1/2010 | | |
| KR | 20-0432490 Y1 | 12/2006 | | |
| KR | 10-2014-0103506 A | 8/2014 | | |
| WO | WO-2004098974 A1 * | 11/2004 | ..... | B61K 9/10 |
| WO | 2019/057875 A1 | 3/2019 | | |

* cited by examiner

*Primary Examiner* — Robert J McCarry, Jr.
(74) *Attorney, Agent, or Firm* — Orbit IP, LLP; Marc G. Martino

(57) ABSTRACT

A device for fixing and positioning a rail monitoring element on a rail web of a rail having a rail foot, the rail web, and a rail head, includes a clamping device which can be fastened to the rail. A pressing ram is for pressing the rail monitoring element against the rail web. The pressing ram can be pressed against the rail web when the device is in the mounted state by means of force generated by a force element. A holder is for receiving the force element.

22 Claims, 5 Drawing Sheets

DEVICE FOR FIXING AND POSITIONING A RAIL MONITORING ELEMENT AND USE OF SAID DEVICE

CROSS-REFERENCE TO RELATED APPLICATIONS

This continuation application claims priority to PCT/EP2020/072881 filed on Aug. 14, 2020 which has published as WO 2021/032627 A1 and also the European patent application number 19192517.1 filed Aug. 20, 2019, the entire contents of which are fully incorporated herein with these references.

DESCRIPTION

Field of the Invention

The invention relates to a device for fixing and positioning a rail monitoring element on a rail web of a rail. The rail web of the rail is arranged between a rail foot and a rail head of the rail. The invention further relates to the use of the device for fixing and positioning a rail monitoring element on a rail web of a rail.

Background of the Invention

A device for fixing a rail monitoring element is known from DE 10 2015 209 721 B3 [3].

To make rail traffic safer, rail monitoring elements, e.g. sensor elements for axle counters, are used. Axle counters can be used in particular to check whether the location of the axle counter has been fully passed by a train, for example to determine whether the associated track sections are free or occupied. Such rail monitoring elements comprise sensor elements which are usually fastened to the rail.

Fiber optic sensors are becoming increasingly important in rail monitoring. One or more sensors, such as fiber Bragg gratings (FBGs), embedded in optical waveguides are used to detect expansion or compression of the optical fiber caused by a mechanical variable, and thus to detect the forces, torques, accelerations, loads, pressure states, etc.

A rail monitoring element having FBG sensors is known from DE 10 2017 216 811 A1 [2], for example. [2] proposes that the rail monitoring element be adhesively fastened, i.e. adhesively bonded, to the rail. However, the rail monitoring element must be positioned and fixed at the mounting site in order to do this.

Mounting a sensor element of an axle counter on a rail by means of a clamping device is known from [3]. The device known from [3] is used to receive a sensor on/fasten a sensor to the rail web and is designed for this purpose. This device is not designed to absorb horizontal forces. Furthermore, this device is adapted to a specific rail foot. A mounting tool should fit a large number of different rail profiles, however. The device from [3] also requires a certain amount of space under the rail, which is not always available.

An L-shaped elastic clamp for fixing an inductive heating device by means of which a planar inductor can be held on the rail web of a rail is known from EP 3 169 138 A1 [1]. A first leg of the clamp engages around the rail foot from below. A second leg of the clamp exerts a lateral preload on the inductor such that said inductor is pressed against the rail web of the rail.

SUMMARY OF THE INVENTION

The problem addressed by the invention is that of providing a device which makes fixing and positioning a rail monitoring element on a rail web of a rail more efficient, simpler, and more precise. The invention also addresses the problem of specifying a use of such a device.

This problem is solved by a device for fixing and positioning a rail monitoring element according to the claims and a use of the device according to the claims. The dependent claims specify advantageous embodiments of the invention.

The device according to the invention has a clamping device by means of which the device can be fastened to the rail. The clamping device is preferably designed in such a way that it can be driven over by a rail vehicle. The device also has a pressing ram for pressing the rail monitoring element against the rail web, as well as a force element. When the device is in the mounted state, the pressing ram can be pressed against the rail web by means of a force generated by the force element. The device preferably further comprises a holder for receiving the force element. The force element is connected to the pressing ram and is designed to exert pressure thereon.

In the mounted state, the device for fixing and positioning the rail monitoring element is fixed to the rail via the clamping device thereof. The clamping device thereby forms a receptacle for a rail part. This can be the rail foot or the rail head, for example. The clamping device can be braced against the rail web. The clamping device can be set to different rail widths and rail profiles.

The design of the device according to the invention allows the force element to generate pressure on the pressing ram in the mounted state, for example when the rail monitoring element is to be fixed on the rail for an adhesive bonding process and positioned. The pressing ram in turn presses the rail monitoring element against the rail web. The rail monitoring element is preferably arranged in the receptacle of the pressing ram. In this state, the pressure on the rail monitoring element is maintained, for example until a potential adhesive bonding process has been completed.

In one embodiment of the invention, the clamping device is a rail foot clamp via which the device can be fastened to the rail foot of the rail. The advantage of a design as a rail foot clamp is that the clamp can still be driven over by a rail vehicle. The rail foot clamp comprises a foot portion which, in the mounted state, engages under the rail foot of the rail and forms a rail foot receptacle. If the rail monitoring element needs to be fixed and positioned above a sleeper of the rail structure, the rail foot clamp can be two-part. Two-part means that a first part of the rail foot clamp can be mounted on one side of the sleeper and a second part of the rail foot clamp can be mounted on the other side of the sleeper.

In another embodiment of the invention, the clamping device is a rail head clamp. The device can be fastened to the rail via the rail head clamp, the rail head clamp engaging over the rail head and gripping the rail web on both sides in the mounted state. As a rule, this embodiment cannot be driven over by a rail vehicle, but has the advantage that no free space under the rail is required. The rail head clamp preferably has clamping jaws which grip the rail web. These clamping jaws can have bevels which are adapted to the shape of the rail web. This ensures that the rail head clamp always grips the rail at the same height, specifically preferably at the desired height. The clamping jaws can have recesses and form a so-called "C-shape" in order to reduce material consumption and the weight of the clamp. Devices having rail head clamps can be used e.g. in subways or third rail systems.

The force element can be mounted on the same side of the rail as the pressing ram. In this embodiment, the force element exerts the force directly on the pressing ram.

In a further embodiment of the invention, the force element can be mounted on the side of the rail opposite the pressing ram. In this embodiment, the force element is designed to generate a pressure against the rail web by means of which the holder of the force element is pulled away from the rail. The side of the holder located on the opposite side of the rail is moved in the same way in the same direction, so that the pressing ram, which is located on the side of the rail opposite the force element, is pressed against the rail web. Depending on the environment where the rail monitoring element is to be mounted, this embodiment may be advantageous, e.g. if there is not enough space available on the side of the rail on which the rail monitoring element is to be mounted. However, it requires space on the side of the rail that is opposite the rail monitoring element.

The force element can be a pneumatic or hydraulic force element, i.e. a pneumatic cylinder or a hydraulic cylinder, for example. The pneumatic cylinder or the hydraulic cylinder preferably has a piston rod which is in operative connection with the pressing ram and is able to transmit the force generated by the force element to the pressing ram. The piston rod is preferably mechanically connected to the pressing ram.

In one embodiment of the invention, the pressing ram can be tilted relative to the at least one piston rod. The pressing ram can thus be moved relative to the axis of the pressure cylinder. This is intended to compensate for when the sensor element cannot be pressed toward the piston rod in a straight line and the plane against which the rail monitoring element is to be pressed is slightly inclined relative to the pressure direction of the piston rod instead.

In a preferred embodiment of the invention, the at least one piston rod is designed to be non-rotatable relative to the pressing ram. In this context, non-rotatable means that no unintentional rotation with an axis of rotation in the direction of the at least one piston rod can take place. This can be achieved, for example, by the at least one piston rod having an angular or oval cross section, by the piston rod being guided by means of a guide groove, or, for example, by two parallel piston rods being provided which transfer the pressing pressure to the pressing ram. Non-rotatability of this kind, which prevents rotation with an axis of rotation in the pressure direction of the at least one piston rod, has the advantage that it is possible to ensure that the rail monitoring element is applied to the rail in a straight line relative to the rail course.

In one embodiment of the invention, the stroke of the pneumatic cylinder or the hydraulic cylinder can be set. In this way, the device can be set to different requirements and rail geometries and/or different geometries of rail monitoring elements.

According to a preferred embodiment of the invention, a control unit is provided which displays and/or sets the pressure exerted on the pressing ram. It is also possible to limit the pressure by means of e.g. a pressure relief valve of which the trigger threshold can be permanently preset. If a pneumatic cylinder is used as a force element, the control unit can have a pressure gauge or interact with a pressure gauge, for example. The pressure exerted by the pneumatic cylinder can also be displayed via the pressure gauge.

In one embodiment of the invention, the pressing ram has a receptacle for the rail monitoring element, the pressing ram having the receptacle being designed in such a way that it can be pressed flat onto the rail web. Such a shape of the pressing ram is particularly advantageous for bringing about a reliable adhesive bonding process of the rail monitoring element to the rail, since flat pressing with a predetermined pressure is particularly advantageous for an adhesive bonding process.

In one embodiment of the invention, the holder is adjustable relative to the clamping device. The adjustment takes place in the mounted state perpendicularly to the underside of the rail, which allows the height at which the rail monitoring element is pressed against the rail to be set. This means that different rail dimensions and rail geometries can be covered.

In a preferred embodiment of the invention, the force element is designed as a magnet which generates a compressive force via an attractive force between the rail and the magnet. Magnets are arranged, for example, in the clamping jaws of an overhead clamp and preferably abut the rail web.

The device is particularly suitable for adhesively bonding a rail monitoring element to a rail web of a rail. The adhesive bonding process usually requires flat pressing with a predetermined pressure. Such an effect can ideally be achieved using the device according to the invention. Use of the device for adhesive bonding is therefore particularly advantageous.

Further advantages of the invention can be found in the descriptions and the drawings. Likewise, according to invention, the aforementioned features and those explained below can each be used individually or together in any desired combination. The embodiments shown and described should not be understood as an exhaustive list; rather, they describe the invention by way of example.

DETAILED DESCRIPTION OF THE PREFERRED EMBODIMENTS

Figure 1:
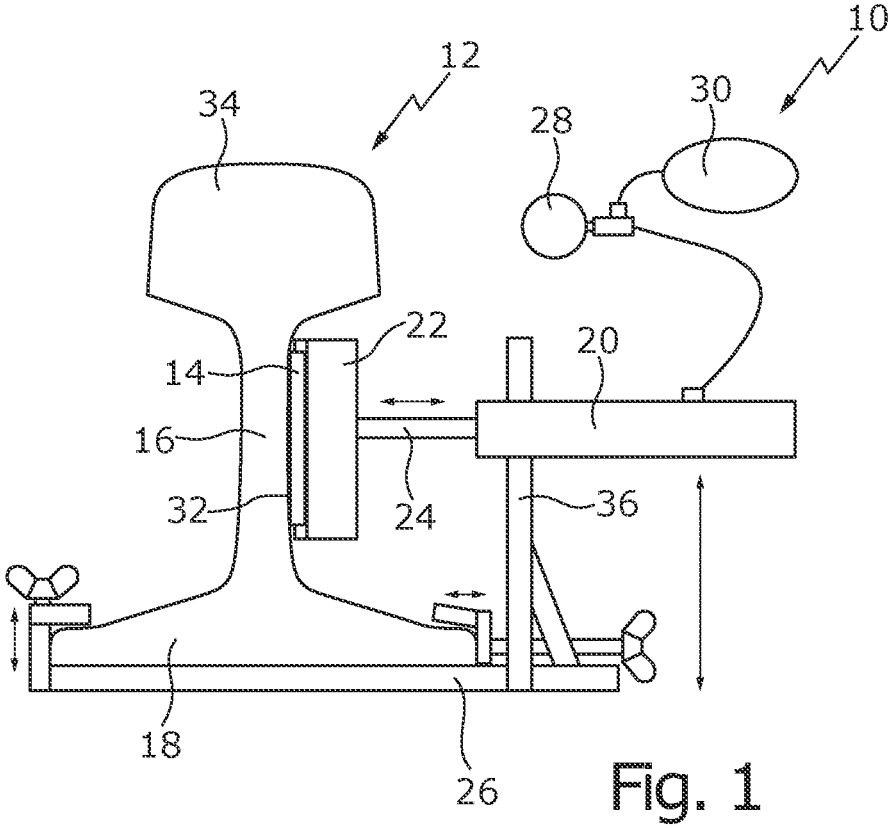
FIG. 1 is a schematic representation of an embodiment of a device according to the invention having a rail foot clamp.

FIG. 1 schematically shows a device 10 for fixing and positioning a rail monitoring element 14. The rail monitoring element 14 is pressed against a rail web 16 of a rail 12.

The rail web 16 of the rail 12 is located between the rail head 34 and the rail foot 18. The device 10 has a force element 20. The force element 20 can be, for example, a hydraulic cylinder or a pneumatic cylinder. The force element 20 exerts force on the pressing ram 22 via a piston rod 24. The pressing ram 22 has a receptacle for the rail monitoring element 14. The holder 36 for the force element 20 is fastened to the rail 12, more precisely to the rail foot 18 of the rail 12, by means of a rail foot clamp 26 in this embodiment. The holder 36 is vertically adjustable relative the plane on which the rail foot 18 lies. The vertical adjustability allows the rail monitoring element 14 to be positioned at the desired height. By means of the force element 20, the rail monitoring element 14 can be pressed against the rail web 16 with the desired pressure via the pressing ram 22. If a pneumatic cylinder is used, the device 10 also has bellows 30. The force exerted by the force element 20 is controlled via a control unit 28. If a pneumatic cylinder is used, a pressure gauge is used to measure and display the pressure being exerted by the pneumatic cylinder. The pressure can be increased via the bellows 30. It can be possible to lower the pressure via the pressure gauge, for example, by releasing air from the pneumatic cylinder.

Figure 2:
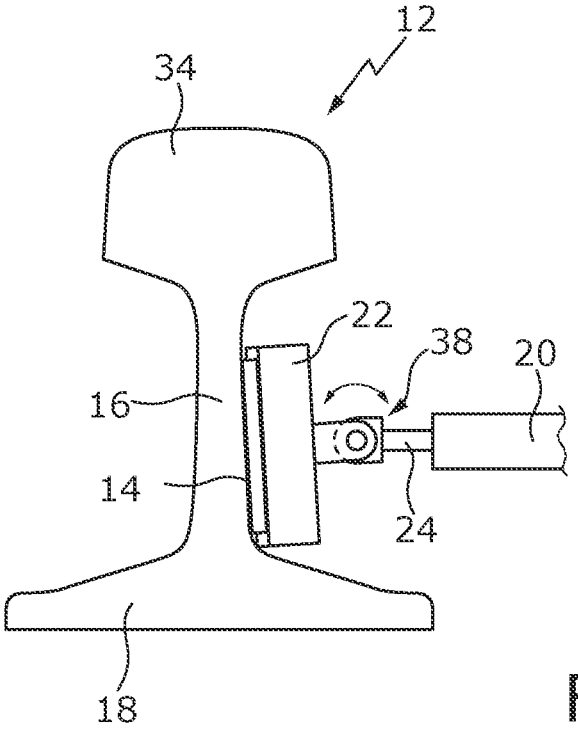
FIG. 2 is a schematic representation of an embodiment of the device according to the invention having a pressing ram with a rotational joint.

FIG. 2 schematically shows a detail from a device 10 in which the pressing ram 22 is rotatably mounted via a rotational joint 38. This allows the pressing ram 22 to pivot relative to the plane of the force element 20 and the piston rod 24. In this way, the inclination of the pressing ram 22 and thus the inclination at which the rail monitoring element 14 is pressed against the rail web 16 can be set.

Figure 3:
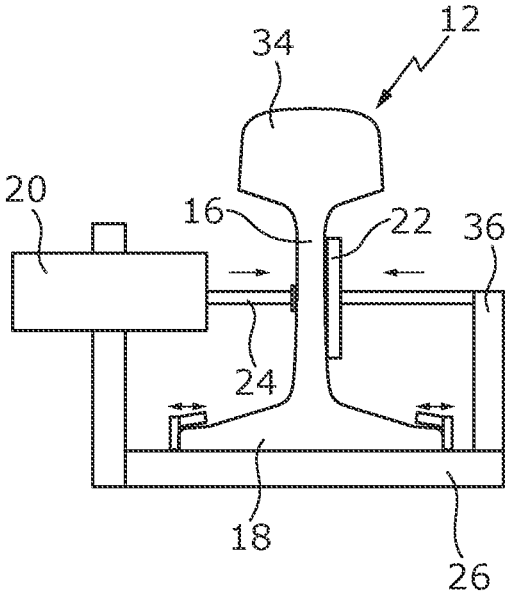
FIG. 3 shows a further embodiment of a device for fixing and positioning a rail monitoring element having a rail foot clamp.

FIG. 3 shows an embodiment of a device 10 for fixing and positioning a rail monitoring element (not shown in FIG. 3 for the sake of clarity) in which the force element 20 and the pressing ram 22 are located on opposite sides of the rail web 16. The holder 36 is fastened to the rail foot 18 of the rail 12 via a rail foot clamp 26. The force element 20 presses with its piston rod 24 against one side of the rail web 16. As a result, the pressing ram 22 is pressed against the rail web 16 via the holder 36 on the opposite side of the rail web 16.

Figure 4:
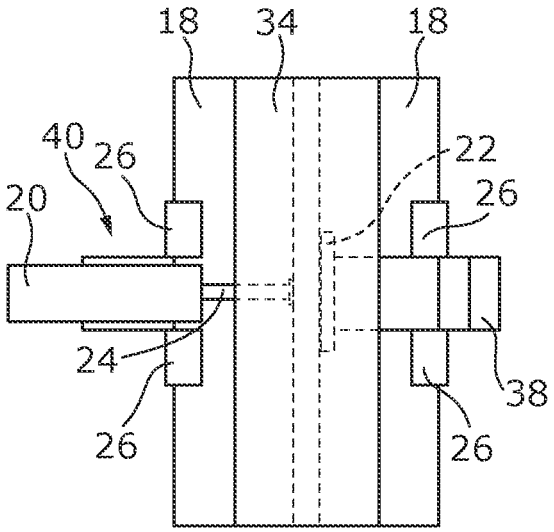
FIG. 4 is a plan view of the embodiment from FIG. 3.

FIG. 4 is a plan view of this embodiment from FIG. 3. The force element 20 is mounted on a carriage 40 here. This carriage 40 extends under the rail foot, mounted in the rail foot clamp 26. The carriage 40 is part of the holder 36 via which the pressing ram 22 is pressed against the rail web 16.

Figure 5:
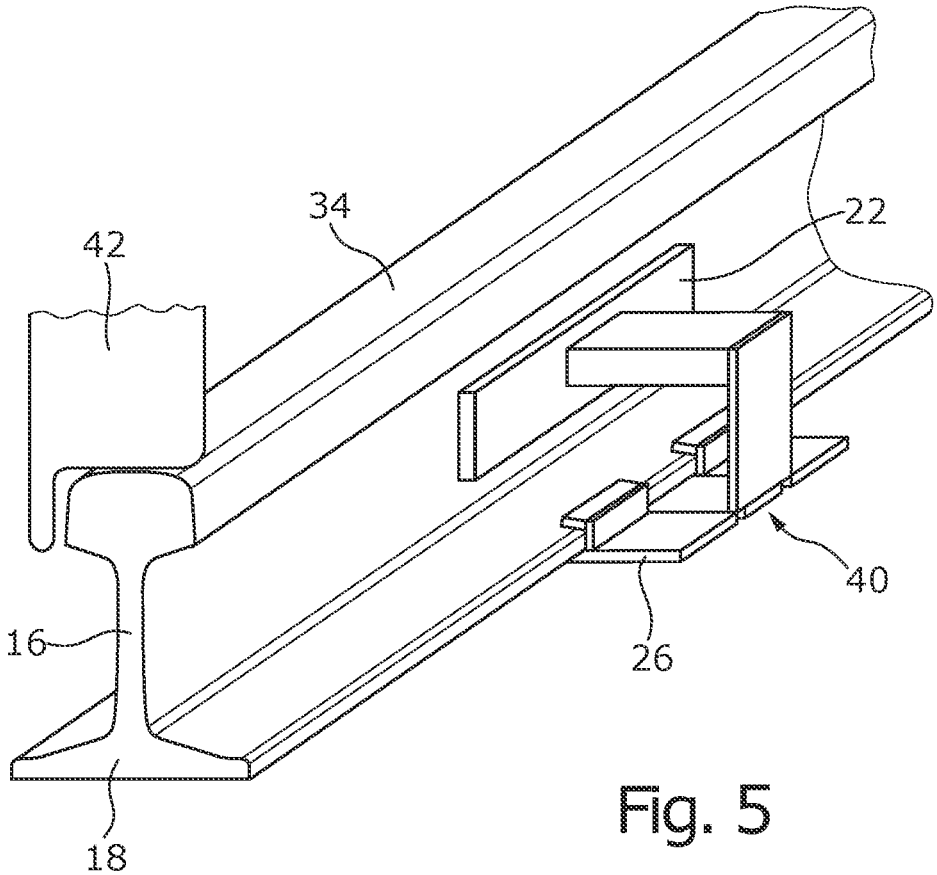
FIG. 5 is a side view of the embodiment from FIGS. 3 and 4.

FIG. 5 schematically shows how the carriage 40 is mounted together with the pressing ram 22 in the rail foot clamp 26. In the example shown, the pressing ram 20 is pressed externally against the rail web 16 of the rail 12. In this context, externally means externally to the two parallel rails of a railway track (not shown). A wheel 42 of a rail vehicle travelling on the rail head 34 is also shown schematically. The rail foot clamp 26 is fastened to the rail foot 18.

Figure 6:
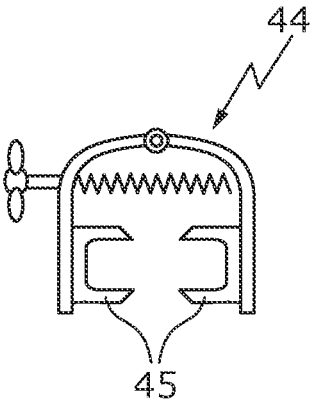
FIG. 6 shows an example of an overhead clamp.

FIG. 6 is a lateral view of an example of a rail head clamp 44 with C-shaped clamping jaws 45. The C-shaped clamping jaws 45 of the overhead clamp 44 are used to grip and clamp the rail 12 and are beveled at their ends and thus adapted to the shape of the rail 12, for example. The C-shape is preferable to the fully filled shape in order to save material and costs, for example.

Figure 7:
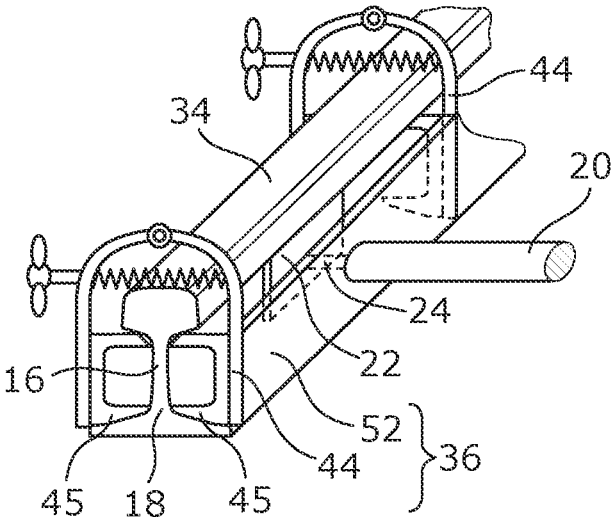
FIG. 7 shows a further embodiment of a device according to the invention having overhead clamps.

In FIG. 7, two of these rail head clamps 44 from FIG. 6 are used in order to implement a device 10 according to the invention by means of these overhead clamps 44. FIG. 7 shows that the overhead clamps 44 engage over the rail head 34 of the rail 12 and grip the rail web 16. This embodiment is selected, for example, if a rail foot clamp 26 cannot be attached to a rail 12 because it is not possible to engage under the rail 12, for example. The overhead clamps 44 are connected by means of a bridge 52 to which the force element 20 is fastened. The overhead clamps 44, together with their clamping jaws 45 and the bridge 52, form an embodiment of a holder 36. The piston rod 24 of the force element 20 passes through the bridge 52 in order to be able to press the pressing ram 22 against the rail web 16.

Figure 8:
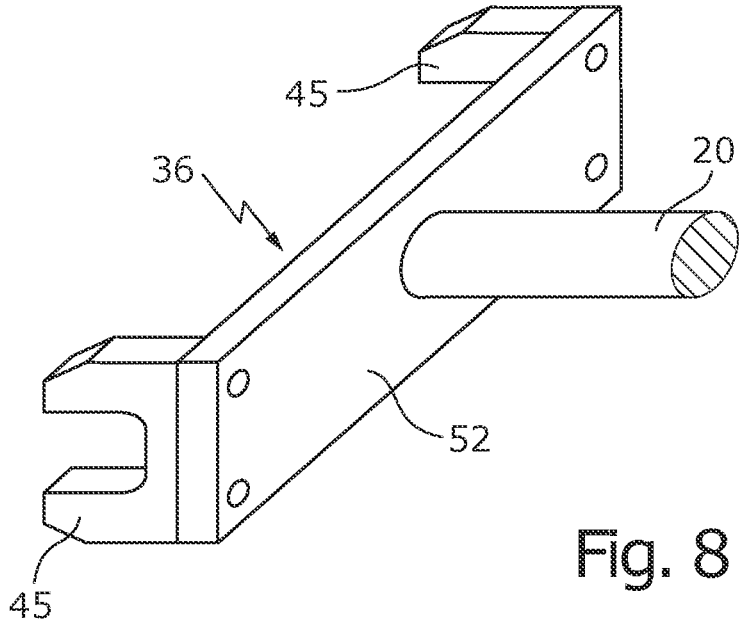
FIG. 8 is a schematic oblique view of a pressing ram from the embodiment from FIG. 7.

FIG. 8 is an enlarged oblique view of the bridge 52 with the C-shaped elements 45 and the force element 20. The bridge 52 and the C-shaped elements 45 together form an embodiment of a holder 36.

Figure 9:
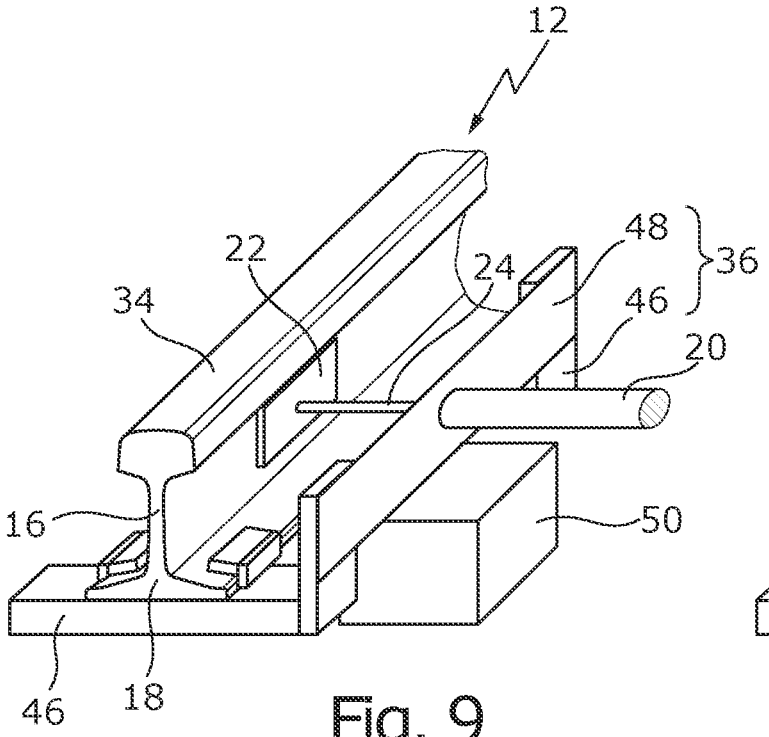
FIG. 9 is a schematic view of an embodiment of the invention having a rail foot clamp.

FIG. 9 shows a further embodiment of a device 10 according to the invention in which fixing and positioning of the rail monitoring element 14 over a sleeper 50 by means of the pressing ram 22 is made possible. The pressing ram 22 is pressed against the rail web 16 of the rail 12 directly above a sleeper 50 here. The fastening to the rail foot 18 takes place by means of two holding elements 46 for a cylinder plate 48. The holding elements 46 and the cylinder plate 48 together form an embodiment of a holder 36. The force element 20 is fastened to the cylinder plate 48. The force element 20 passes through the cylinder plate 48 with its piston rod 24, and thus presses the pressing ram 22 against the rail web 16.

Figure 10:
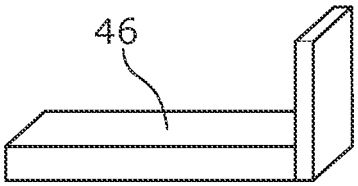
FIG. 10 is a schematic view of a holding element for the cylinder plate from FIG. 9.

In FIG. 10, a holding element 46 for the cylinder plate 48 is shown again schematically.

Figure 11:
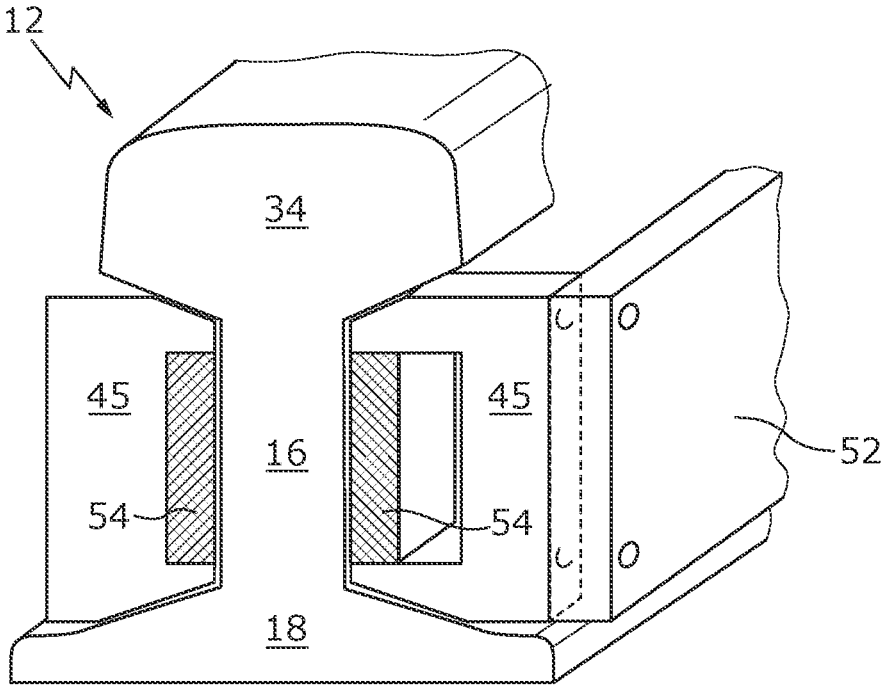
FIG. 11 is a schematic view of an embodiment of the invention with magnets as the force element.

FIG. 11 is a schematic view of a holder 36 with a bridge 52 and C-shaped clamping jaws 45. A magnet 54 is arranged in each clamping jaw 45. An example of a magnet 54 which completely fills the cavity of the C-shaped clamping jaw 45 is shown on the left in FIG. 11. On the right is an example of a magnet 54 in which the cavity of the C-shaped clamping jaw 45 is only partially filled by the magnet 54 on the side facing the rail 12 in the mounted state. In the mounted state, the magnet 54 is in contact with the rail web 16. Due to the attraction between the rail 12 and the magnet 54, a compressive force is exerted on the holding element 22 via the bridge 52 and the holding element is pressed against the rail web (not shown here).

Figure 12:
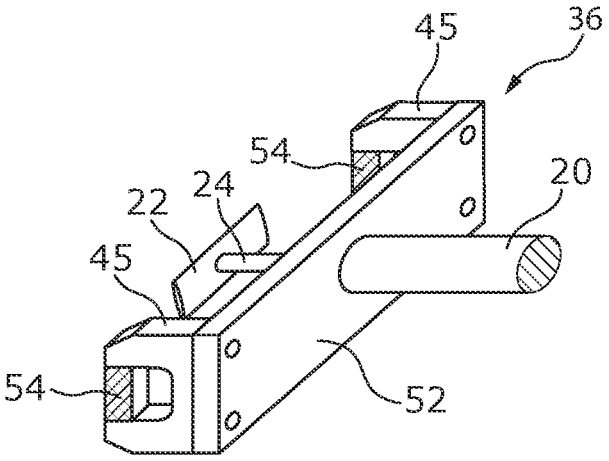
FIG. 12 shows a holder with a magnetic force element.

FIG. 12 shows the holder 36 with the bridge 52, the clamping jaws 45, and the magnets 54 arranged within the clamping jaws. In this embodiment, the magnets do not completely fill the cavity of the C-shaped clamping jaws 45. In addition to the magnets 54, this embodiment has a further force element in the form of a pressure cylinder 20.

The magnets 54 hold the entire device on the rail web 52. The pressure cylinder 20 cannot "push away" the device when it is actuated. The magnets 54 and the pressure cylinder 20 are therefore preferably matched to one another in such a way that the following applies: force generated by magnets>force generated by pressure cylinder 20. As a rule, the pressing force of the magnets 54 is greater than the pressing force of the pressure cylinder 20. Due to the greater pressing force, this embodiment is particularly suitable, for example, for fixing adhesive bonds in which the adhesive has to be heated.

Figure 13:
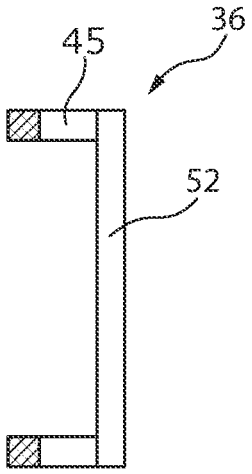
FIG. 13 is a plan view of the holder from FIG. 12.

FIG. 13 shows a plan view of a holder 36 with C-shaped clamping jaws 45 and the bridge 54. Here, the pressing force is only generated by the magnets 54, which are arranged within the clamping jaws 45. This embodiment is particularly suitable for fixing adhesive bonds where the adhesive only needs one fixing, for example.

LIST OF REFERENCE SIGNS

10 Device for fixing and positioning
12 Rail

14 Rail monitoring element
16 Rail web
18 Rail foot
20 Force element
22 Pressing ram
24 Piston rod
26 Rail foot clamp
28 Control unit
30 Bellows
32 Adhesive layer
34 Rail head
36 Holder for force element
38 Rotational joint
40 Carriage
42 Wheel
44 Rail head clamp
45 C-shaped clamping jaws
46 Holding element for cylinder plate
48 Cylinder plate
50 Sleeper
52 Bridge
54 Magnet

LIST OF DOCUMENTS

[1] EP 3 169 138 A1
[2] DE 10 2017 216 811 A1
[3] DE 10 2015 209 721 B3

What is claimed is:

1. A device for fixing and positioning a rail monitoring element on a rail web of a rail having a rail foot, the rail web and a rail head, comprises:

a clamping device configured for removably fastening the device to the rail;

a pressing ram for pressing the rail monitoring element against the rail web;

a force element, wherein the pressing ram can be pressed against the rail web when the device is in the mounted state by force generated by the force element; and a holder for receiving the force element;

wherein the pressing ram has a receptacle configured for positioning the rail monitoring element during fixing of the rail monitoring element to the rail web.

2. The device according to claim 1, wherein the clamping device is a rail foot clamp wherein the clamping device can be fastened to the rail foot of the rail separate from the pressing ram and the force element.

3. The device according to claim 1, wherein the clamping device is a rail head clamp for fastening the device to the rail, the rail head clamp engaging over the rail head and gripping both sides of the rail web in the mounted state.

4. The device according to claim 1, wherein the force element is located on the same side of the rail as the pressing ram in the mounted state.

5. The device according to claim 1, wherein the force element is located on the side of the rail opposite the pressing ram in the mounted state.

6. The device according to claim 1, wherein the force element is a pneumatic or hydraulic force element.

7. The device according to claim 6, wherein the force element is a pneumatic cylinder or hydraulic cylinder which has at least one piston rod that is in operative connection with the pressing ram.

8. The device according to claim 7, wherein the pressing ram can be tilted relative to the at least one piston rod.

9. The device according to claim 7, wherein the at least one piston rod is designed to be non-rotatable relative to the pressing ram.

10. The device according to claim 7, wherein the stroke of the pneumatic cylinder or hydraulic cylinder can be set.

11. The device according to claim 1, wherein a control unit is provided which displays and/or sets the pressure exerted on the pressing ram.

12. The device according to claim 1, wherein the pressing ram is designed in such a way that it can be pressed flat against the rail web.

13. The device according to claim 1, wherein the holder is adjustable relative to the clamping device, the adjustment taking place perpendicularly to the underside of the rail in the mounted state.

14. The device according to claim 1, wherein the clamping device comprises magnets configured for fastening the device to the rail foot of the rail.

15. Use of the device according to claim 1 for adhesively bonding the rail monitoring element to the rail web of the rail.

16. The device according to claim 2, wherein the force element is located on the same side of the rail as the pressing ram in the mounted state.

17. The device according to claim 3, wherein the force element is located on the same side of the rail as the pressing ram in the mounted state.

18. The device according to claim 2, wherein the force element is located on the side of the rail opposite the pressing ram in the mounted state.

19. The device according to claim 3, wherein the force element is located on the side of the rail opposite the pressing ram in the mounted state.

20. The device according to claim 8, wherein the at least one piston rod is designed to be non-rotatable relative to the pressing ram.

21. A device for fixing and positioning a rail monitoring element on a rail web of a rail having a rail foot, the rail web and a rail head, comprises:

a clamping device configured for fastening the device to the rail;

a pressing ram for pressing the rail monitoring element against the rail web;

a force element, wherein the pressing ram can be pressed against the rail web when the device is in the mounted state by force generated by the force element; and a holder for receiving the force element;

wherein a control unit is provided which displays and/or sets the pressure exerted on the pressing ram.

22. A device for fixing and positioning a rail monitoring element on a rail web of a rail having a rail foot, the rail web and a rail head, comprises:

a clamping device configured for fastening the device to the rail;

a pressing ram for pressing the rail monitoring element against the rail web;

a force element, wherein the pressing ram can be pressed against the rail web when the device is in the mounted state by force generated by the force element;

wherein the clamping device is a rail foot clamp configured to be fastened to the rail foot of the rail separate from use of either the pressing ram or the force element.

* * * * *